US006065759A

United States Patent [19]

Wu

[11] Patent Number: 6,065,759

[45] Date of Patent: May 23, 2000

[54] JUMP SKATE

[75] Inventor: Thomas J. Wu, McLean, Va.

[73] Assignee: American Composites Corporation, McLean, Va.

[21] Appl. No.: 09/159,571

[22] Filed: Sep. 24, 1998

[51] Int. Cl.[7] ..... A63C 1/00

[52] U.S. Cl. ..... 280/11.115; 280/11.15; 280/11.22; 280/11.27

[58] Field of Search ..... 280/11.115, 11.19, 280/11.22, 11.27, 11.28, 11.14, 11.15, 11.23

[56] References Cited

U.S. PATENT DOCUMENTS

| | | | |
|---|---|---|---|
| 942,333 | 12/1909 | Lennox | 280/11.115 |
| 999,660 | 8/1911 | Koppel | 280/11.115 |
| 1,338,813 | 5/1920 | Chiarelli | 280/11.115 |
| 1,597,792 | 8/1926 | Hoff et al. . | |
| 2,174,990 | 10/1939 | Maguire | 280/11.115 |
| 4,351,538 | 9/1982 | Berta | 280/11.26 |
| 4,451,055 | 5/1984 | Lee | 280/11.115 X |
| 5,503,413 | 4/1996 | Belogour | 280/11.22 |

FOREIGN PATENT DOCUMENTS

| | | | |
|---|---|---|---|
| 3730839 | 3/1989 | Germany | 280/11.115 |

*Primary Examiner*—Michael Mar

[57] ABSTRACT

A jump skate comprises a boot with a base attachment, a surface engager, and a link/spring mechanism, which uses large spring deformation to boost a skater in jumping.

The link/spring mechanism comprises at least two links and at least one spring (coil or wound). The links and the spring(s) are made of metallic, synthetic, or composite materials.

The link/spring mechanism is connected to the boot and the surface engager with pin joints in such a way that allows large relative displacement with zero rotation between the boot and the surface engager, which offers improved control of the surface engager for skate jump/landing.

The spring(s) is installed in such a way that it deforms with relative displacements between the boot and the surface engager. Thus a skater can first store energy into the spring(s) by forcing the boot down towards the surface engager and then jump to release the energy for further height.

3 Claims, 4 Drawing Sheets

JUMP SKATE

BACKGROUND OF THE INVENTION

1. Field of the Invention

The present invention relates to a skate for jumping. More particularly, the invention relates to improved in-line roller skates, improved ice skates, and improved conventional roller skates, which provide effective energy storage/release to enable the relatively high jump, controlled landing, and reduced impact.

2. Description of the Prior Art

Spring-assisted skates are disclosed in the patent art. Most of these prior arts use small springs and claim shock absorbing characteristics. Only a couple of prior arts claim jump-assisting characteristics. Such skates are disclosed in U.S. Pat. Nos. 1,597,792 issued to E. A. Hoff et al (1926); 4,351,538 issued to Berta (1982); and 5,503,413 issued to Belogour (1996). These prior arts include an ice skate, a conventional roller skate, and an in-line roller skate. Each of the skates comprises components including a boot, a surface-engaging blade or roller assembly (hereinafter referred to as the surface engager), and a means using spring(s) for shock absorbing or jump assistance.

In general, these prior spring-assisted skates fall into the following disadvantages:

(a) No effective rotational control of the surface engager from the boot. In particular, the surface engager is allowed to rotate with respect to the boot, thus a skater cannot select a specific part of the surface engager to initiate a jump or support a landing. In other words, a skater's jump is limited to certain ways, and the landing becomes more difficult because of the uncertain orientation of the surface engager.

(b) No significant storage/release of energy to assist a jump because only small spring deformation is practical for these prior arts. Based on their design configurations, prior arts may further lose control of surface engagers and skate structural integrity if relatively large spring deformation is adopted.

SUMMARY OF THE INVENTION

Accordingly, objects and unique advantages of the present invention are:

1. to provide a spring-assisted skate with large spring deformation for effective jump assistance
2. to provide a spring-assisted skate with zero rotation between the surface engager and the boot for effective jump/landing control
3. to provide a spring-assisted skate with structural integrity during large deformation.

These and other objects of the invention are realized by interposing a link/spring mechanism between the boot and the surface engager.

A link/spring mechanism comprises at least two links and at least one spring (coil or wound). The said links and spring(s) are made of metallic (such as aluminum alloy), synthetic (such as plastics), or composite materials (such as graphite/epoxy).

The link/spring mechanism is connected to the boot and the surface engager with pin (also made of metallic, synthetic, or composite materials) joints in such a way that i. the spring(s) deforms with relative displacements between the boot and the surface engager ii. the boot base is maintained parallel to the surface engager throughout the entire range of skate deformation.

Thus a skater can force the boot down towards the surface engager to store energy and then jump to release the energy for increased height. Being certain that the surface engager is parallel to the boot base, the skater can land with as much control as if wearing a regular skate—even more comfortably due to the effective shock-absorbing characteristics of the jump skate.

Other objects, features and advantages of the invention shall become apparent from the following detailed description of the preferred embodiments thereof, when considered in conjunction with the drawings wherein like reference characters refer to corresponding parts in the several views.

DETAILED DESCRIPTION OF THE PREFERRED EMBODIMENTS

1. First Preferred Embodiment

Jump skates according to the first preferred embodiments of the invention shall now be described with initial reference to FIGS. 1(*a*)–3(*b*).

Figures 1A, 1B:
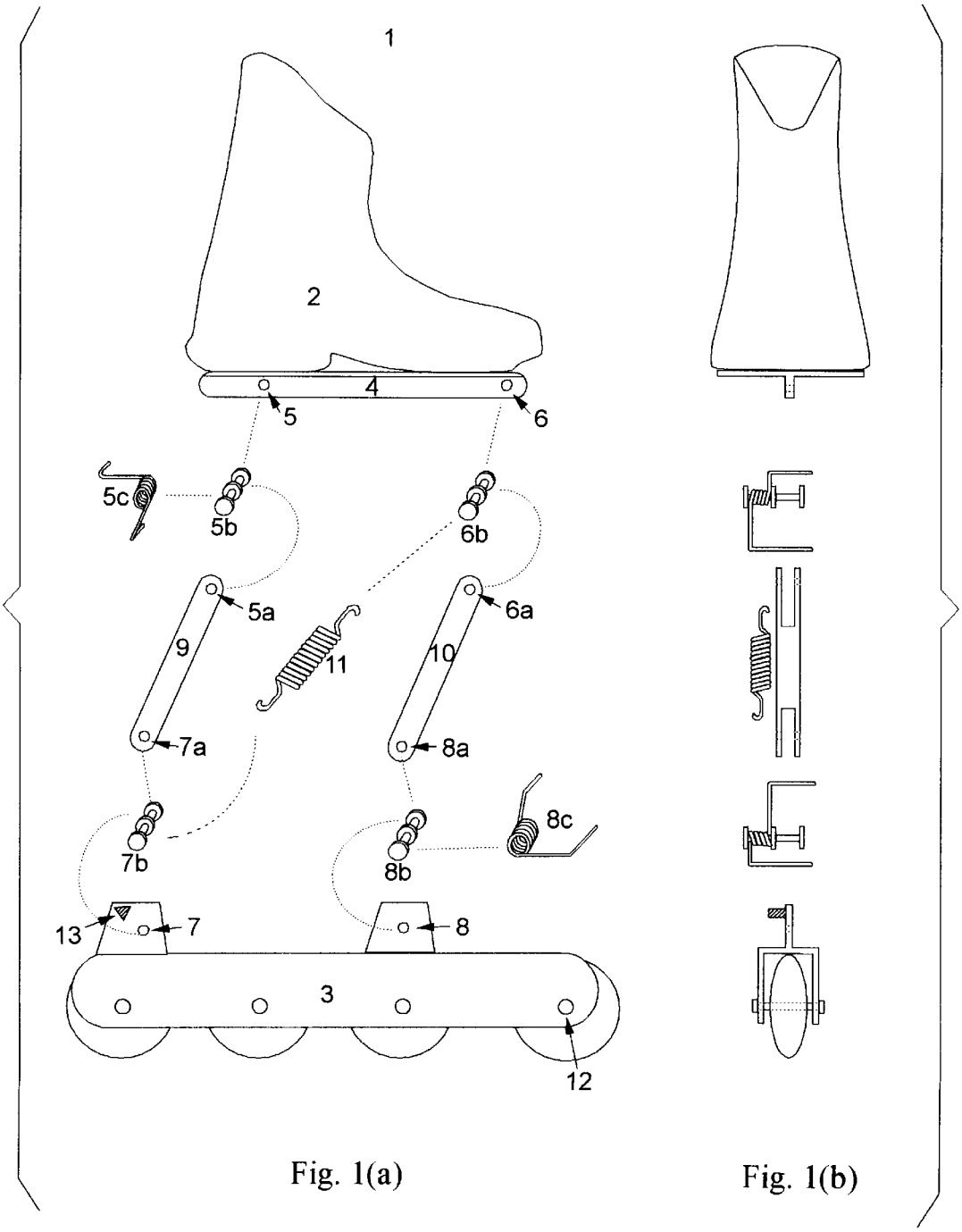
FIGS. 1(*a*) and 1(*b*) are exploded perspectives illustrating the side and front views, respectively, of the first preferred embodiment of the present invention related to a jump in-line roller skate using three springs.

As shown in FIGS. 1(*a*) and 1(*b*), jump skate 1 includes a boot 2 and an in-line roller assembly as the surface engager 3. Boot 2 includes a base attachment 4 with two machined holes 5 and 6. (A base attachment may comprise a single element or multiple elements that are attached to the sole and heel with screws, adhesive, or other means.) Surface engager 3 includes attachments with two machined holes 7 and 8. Distance between holes 5 and 6 is the same as that between holes 7 and 8.

Shown between the boot base attachment 4 and the surface engager 3 is the link/spring mechanism that comprises Links 9 and 10 (of equal length) with four machined holes 5*a*, 6*a*, 7*a*, and 8*a*

Connector pins 5*b*, 6*b*, 7*b*, and 8*b*

Wound springs 5*c* and 8*c*

Coil spring 11

Pins 5*b*, 6*b*, 7*b*, and 8*b* are shown to connect links 9 and 10 to the boot base attachment 4 and the surface engager 3 by fastening hole 5 to hole 5*a,* hole 6 to hole 6*a,* hole 7 to hole 7*a,* and hole 8 to hole 8*a,* respectively. These links and pin joints assure the skate structural integrity while allowing displacements between the boot base attachment 4 and the surface engager 3.

Note that, geometrically, the boot base attachment 4, the surface engager 3, links 9 and 10 together form the four sides of a parallelogram to assure that the surface engager 3 will always be parallel to the boot base attachment 4. The present invention thus surpasses all prior arts in controlling the surface engager for skate jump/landing.

Wound spring 5*c* is shown to be installed on pin 5*b,* with two spring legs pushing against link 9 and the boot base attachment 4. Similarly, wound spring 8*c* is shown to be installed on pin 8*b,* with two spring legs pushing against link 10 and the top of surface engager 3. In addition, coil spring 11 is connected between pins 6*b* and 7*b.* All three springs will deform and store energy with relative displacements between the boot base attachment 4 and the surface engager 3. (For a simplified design, using any one of the three springs alone can serve the purpose of jump assistance.)

Because most of the space between the boot base attachment 4 and the surface engager 3 can be used for skate/spring deformation and energy storage/release, the present invention is therefore very effective for jump assistance. In addition, because all links and spring(s) are located under the boot base attachment 4 without any hazardous protrusions around the boot (such as in the U.S. Pat. No. 5,503,413 to Belogour), the present invention adds safety to performance.

For the stable support of a skater's weight, the front segment of the surface engager 3 is made so long that it extends the front roller axle 12 beyond the boot toe (hole 6) throughout the entire range of skate deformation.

A stopper element 13 is added onto surface engager 3 to keep links 9 and 10 (through the connection to the surface engager 3) always "forward inclined" such that the boot can only move forward when it is forced downward. Thus, the stopper element 13 reduces uncertainty in the skate's for improved control. (The present invention is also applicable to a jump skate with "rearward inclined" links. Nevertheless, a stopper is needed to maintain a rearward incline of the links.)

Finally, the flat top portion of the surface engager 3 serves as an additional stopper that limits the downward rotation of links 9 and 10 and defines the maximal deformation range of the skate.

Figure 2A:
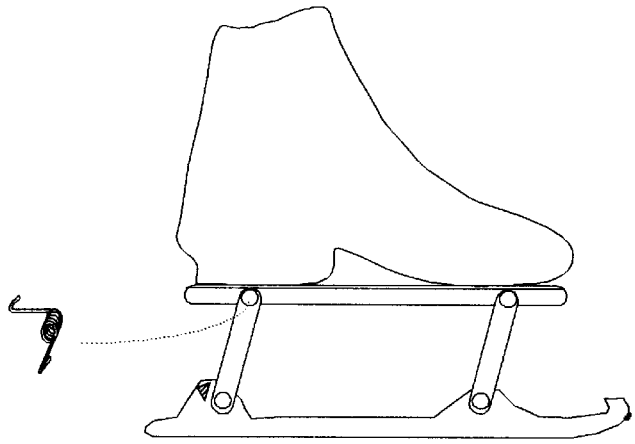
FIGS. 2(*a*) and 2(*b*) illustrate the side and front views, respectively, of the first preferred embodiment of the present invention related to a jump ice skate using one spring.
Figure 2B:
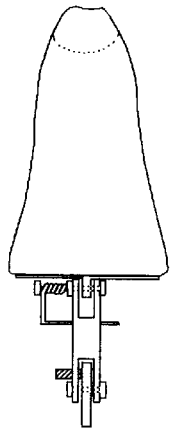

FIGS. 2(*a*) to 2(*b*) illustrate the side and front views, respectively, of the first preferred embodiment of the invention related to a jump ice skate using one spring.

Figure 3A:
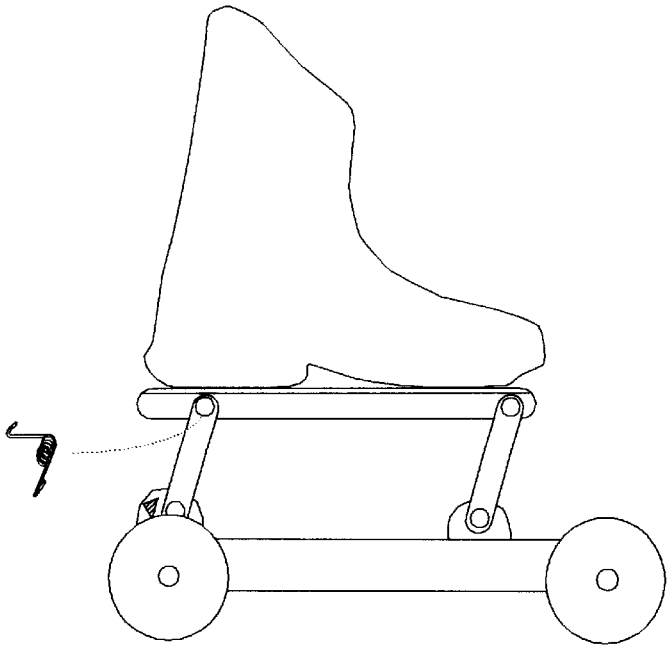
FIGS. 3(*a*) and 3(*b*) illustrate the side and front views, respectively, of the first preferred embodiment of the present invention related to a jump conventional roller skate using one spring.
Figure 3B:
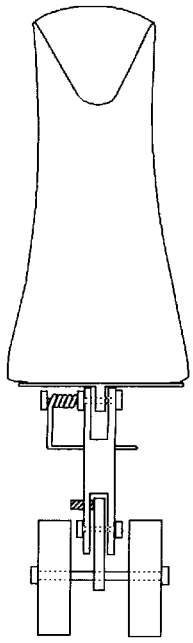

FIGS. 3(*a*) to 3(*b*) illustrate the side and front views, respectively, of the first preferred embodiment of the invention related to a jump conventional roller skate using one spring.

2. Second Preferred Embodiment

Figures 4A, 4B:
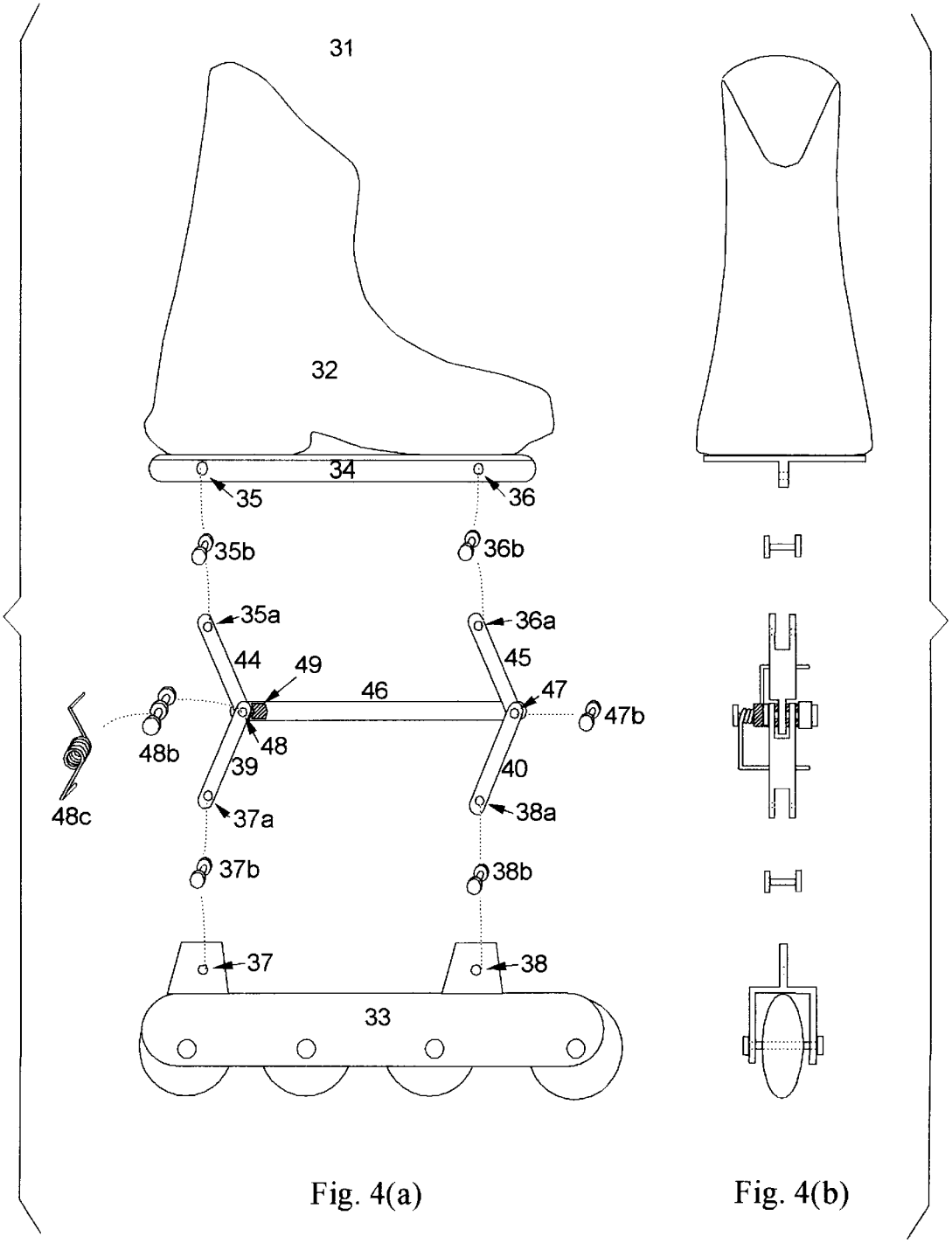
FIGS. 4(*a*) and 4(*b*) are exploded perspectives illustrating the side and front views, respectively, of the second preferred embodiment of the present invention related to a jump in-line roller skate using one spring.

FIGS. 4(*a*)–6(*b*) illustrate a second preferred embodiment of the present invention. In comparison to the first embodiment, the second embodiment minimizes the relative horizontal displacement between the boot and the surface engager, thus offering further control to a jump skate.

As shown in FIGS. 4(*a*) and 4(*b*), jump skate 31 includes a boot 32 and an in-line roller assembly as the surface engager 33. Boot 32 includes a base attachment 34 with two machined holes 35 and 36. Surface engager 33 includes attachments with two machined holes 37 and 38. Distance between holes 35 and 36 is the same as that between holes 37 and 38.

Shown between the boot base attachment 34 and the surface engager 33 is the link/spring mechanism that comprises Links 39, 40, 44, 45, and 46

Pins 35*b,* 36*b,* 37*b,* 38*b,* 47*b,* and 48*b*

Wound springs 48*c*

Links 39, 40, 44, 45, and 46 are connected by pins 47*b* and 48*b,* through holes 47 and 48. Links 39, 40, 44, and 45 are equal in length, each with an additional machined hole (holes 37*a,* 38*a,* 35*a,* and 36*a,* respectively) for connections to the surface engager 33 and the boot base attachment 34. The center link 46 has a length equal to the distance between holes 35 and 36, which also equals to the distance between holes 37 and 38.

Pins 35*b* and 36*b* are shown to connect links 44 and 45 to the boot base attachment 34 by fastening hole 35 to hole 35*a,* and hole 36 to hole 36*a,* respectively. Similarly, pins 37*b* and 38*b* are shown to connect links 39 and 40 to the surface engager 33 by fastening hole 37 to hole 37*a,* and hole 38 to hole 38*a,* respectively. These links and pin joints assure the skate structural integrity while allowing displacements between the boot and the surface engager.

Note that, geometrically, the boot base attachment 34, the surface engager 33, and all five said links together form two superimposed parallelograms to assure that the surface engager 33 will always be parallel to the boot base attachment 34.

The wound spring 48*c* is shown to be installed on pin 48*b,* with two spring legs pushing against links 39 and 44, which will deform and store energy with relative displacements between the boot base attachment 34 and the surface engager 33. In addition, the deformation of wound spring 48*c* will push forward the center link 46 and suppress relative horizontal displacement between the boot base attachment 34 and the surface engager 33.

Having eliminated the relative rotation and horizontal displacement between the boot base 34 and the surface engager 33, the present invention thus surpasses all prior arts in controlling the surface engager for skate jump/landing.

Because most of the space between the boot base attachment 34 and the surface engager 33 can be used for skate/spring deformation and energy storage/release, the present invention is therefore very effective for jump assistance. In addition, because all links and spring(s) are located under the boot base attachment 34 without any hazardous protrusions around the boot (such as in the U.S. Pat. No. 5,503,413 to Belogour), the present invention adds safety to performance.

A stopper element 49 is added onto the center link 46 to keep it always "forward shifted" when the boot base 34 is forced down toward the surface engager 33. (The present invention is also applicable to a jump skate with a "rearward shifted" center link. Nevertheless, stopper elements are still needed to maintain a rearward shift of the center link 46.)

Finally, the flat portions of the surface engager 33 and the boot base attachment 34 serve as additional stoppers that limit the rotation of links 39, 40, 44, and 45, and define the maximal deformation range of the skate.

Figure 5A:
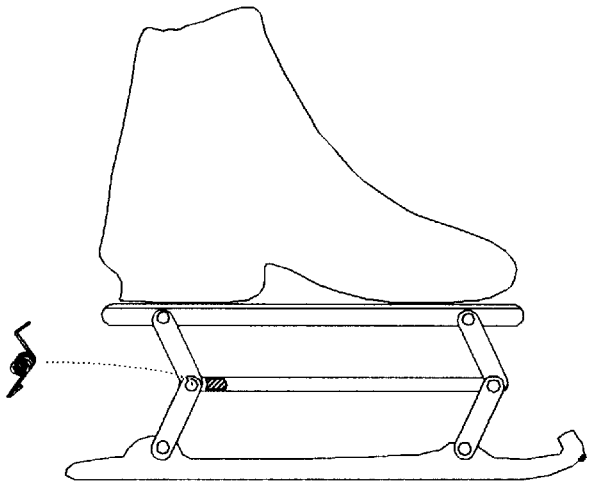
FIGS. 5(*a*) and 5(*b*) illustrate the side and front views, respectively, of the second preferred embodiment of the present invention related to a jump ice skate using one spring.
Figure 5B:
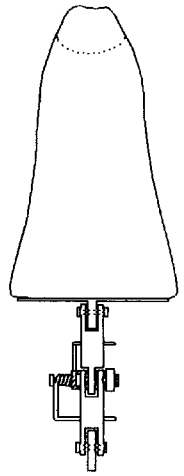

FIGS. 5(*a*) to 5(*b*) illustrate the side and front views, respectively, of the second preferred embodiment of the invention related to a jump ice skate using one spring.

Figure 6A:
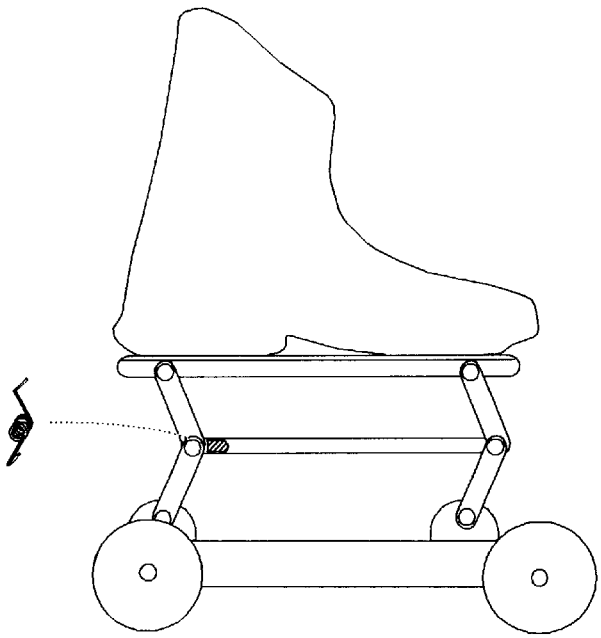
FIGS. 6(*a*) and 6(*b*) illustrate the side and front views, respectively, of the second preferred embodiment of the present invention related to a jump conventional roller skate using one spring.
Figure 6B:
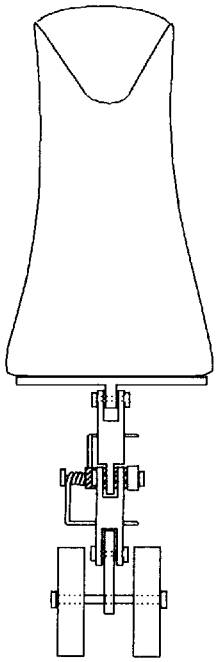

FIGS. 6(*a*) to 6(*b*) illustrate the side and front views, respectively, of the second preferred embodiment of the invention related to a jump conventional roller skate using one spring.

The invention therefore provides a novel and improved skate that allows quick storage/release of large amounts of energy and enables a skater to jump higher into the air and to land more comfortably than when wearing a regular skate.

It is to be understood that the form of the invention herein shown and described is to be taken as the preferred embodiments thereof, and that various changes in shape, material, size, and arrangement of parts may be resorted to without departing from the spirit or the invention or scope of the subjoined claims.

I claim:

1. A jump skate for permitting a skater to perform jumping maneuvers comprising:

a boot;

a base attachment member having a planar portion attached to a bottom of the boot and at least one elongated attachment flange portion depending from the planar portion and extending along a longitudinal axis of the skate;

an elongated base frame with a ground traversing lower portion, a plurality of base flange portions including front and rear base flange portions extending upwardly from front and rear portions respectively of the base frame;

a plurality of link members including a front link member and a rear link member, the front link member having an upper end portion formed by a pair of laterally spaced flange members for receiving therebetween a front portion of the attachment flange portion and pivotally connected thereto by a first pin, and a lower end portion formed by a pair of laterally spaced flange members for receiving therebetween the front base flange portion and pivotally connected thereto by a second pin, and the rear link member having an upper end portion formed by a pair of laterally spaced flange members for receiving therebetween a rear portion of the attachment flange portion and pivotally connected thereto by a third pin, and a lower end portion formed by a pair of laterally spaced flange members for receiving therebetween the rear base flange portion and pivotally connected thereto by a fourth pin; and a plurality of springs including first, second, and third springs, the first spring having one end attached to the first pin and an opposite end attached to the fourth pin for applying a tension force therebetween for biasing the base attachment member away from the base frame, the second spring being wound around the second pin and having ends engaged with the front base flange portion and the lower end portion of the front link member for biasing the upper end portion of the front link member in a direction away from the base frame, and the third spring being wound around the third pin and having ends engaged with the attachment flange portion and the upper end portion of the rear link member for biasing the lower end portion of the rear link member in a direction away from the base attachment member.

2. The jump skate of claim 1, wherein the base frame is formed by a pair of longitudinally extending vertical side walls and a horizontally extending top wall interconnecting upper edges of the vertical side walls.

3. The jump skate of claim 2, wherein the ground traversing lower portion of the base frame includes a plurality of wheels rotatably supported in an in-line configuration between the pair of vertical side walls.

* * * * *